US007028665B2

(12) United States Patent
Taguchi

(10) Patent No.: US 7,028,665 B2
(45) Date of Patent: Apr. 18, 2006

(54) FUEL SUPPLY APPARATUS

(75) Inventor: Naohiro Taguchi, Kawasaki (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/104,846

(22) Filed: Apr. 13, 2005

(65) Prior Publication Data

US 2005/0229902 A1 Oct. 20, 2005

(30) Foreign Application Priority Data

Apr. 16, 2004 (JP) ..... 2004-121082

(51) Int. Cl.
*F02M 61/14* (2006.01)

(52) U.S. Cl. ..... 123/336; 123/470

(58) Field of Classification Search ..... 123/336, 123/337, 299, 432, 319, 402, 344, 399, 442, 123/470, 472
See application file for complete search history.

(56) References Cited

U.S. PATENT DOCUMENTS 4,325,341 A * 4/1982 Yamauchi et al. ..... 123/472
6,295,969 B1 * 10/2001 Kato et al. ..... 123/470
2004/0237934 A1 * 12/2004 Tsukui et al. ..... 123/336

FOREIGN PATENT DOCUMENTS

JP 2001-115931 4/2001

* cited by examiner

*Primary Examiner*—Andrew M. Dolinar
*Assistant Examiner*—Johnny H. Hoang
(74) *Attorney, Agent, or Firm*—R. Neil Sudol; Henry D. Coleman; William J. Sapone

(57) ABSTRACT

To inhibit vapor in a fuel flowing to a second fuel distribution path by shortening a fuel communicating pipe between first and second fuel distribution paths in respective sides of a throttle body, first and second throttle bodies (1, 3) are arranged in parallel, first and second throttle valves (8, 9) are attached to a single throttle valve shaft (5), a throttle drum (6) is attached to a left end (5*c*) of the throttle valve shaft (5), first and second fuel supply bodies (10, 11) including first and second fuel injection valves (J1, J2) are arranged respectively in one side (B) and the other side (A) of the throttle bodies, both the fuel supply bodies (10, 11) are connected by a fuel communicating path (16), and the fuel communicating path (16) is arranged inn a space among throttle valve shaft (5), upper ends (1*x*, 3*x*) of the throttle bodies, opposing side surfaces of both the throttle bodies (1, 3).

5 Claims, 15 Drawing Sheets

FUEL SUPPLY APPARATUS

TECHNICAL FIELD

The present invention relates to a fuel supply apparatus for supplying a fuel to an internal combustion engine, and more particularly to a fuel supply apparatus in a fuel injection type which injects and supplies fuel having pressure increased by a fuel pump toward inner sides of a plurality of intake pipes by a plurality of fuel injection valves.

BACKGROUND ART

A conventional fuel supply apparatus using a fuel injection valve is shown in FIGS. 22 and 23.

FIG. 22 is an upper plan view in the case of seeing a fuel supply apparatus from the above, and FIG. 23 is a vertical cross sectional view of a main portion in a line Z—Z of FIG. 22.

Reference numeral 80 denotes a first throttle body in which a first intake path 81 is provided therethrough in a vertical direction, in FIG. 23. The first intake path 81 is opened and closed by a first throttle valve 83 attached to a first throttle valve shaft 82.

An upper opening 81*a* of the first intake path 81 communicates with an inner side of an air cleaner box 84 arranged in an upper side via a duct or the like, a lower opening 81*b* of the first intake path 81 is connected to a first intake pipe 85 bent toward the other side A in accordance with extending close to a lower side in FIG. 23, and a downstream side of the first intake pipe 85 is connected to a first cylinder 86, for example, constituting a V-type engine.

Reference symbol J1 denotes an electromagnetic type first fuel injection valve attached to the first throttle body 80. A lower side of the first fuel injection valve J1 is inserted and supported to the first throttle body 80, and an upper side thereof is inserted and supported to a first fuel supply pipe 87. The first fuel injection valve J1 is pinched by the first throttle body 80 and the first fuel supply pipe 87 by screw fixing the first fuel supply pipe 87 to the first throttle body 80 via a screw 88.

Further, it is necessary that the fuel injected by the first fuel injection valve J1 is supplied along a curve of the first intake pipe 85 as much as possible. Accordingly, the first fuel injection valve J1 is first arranged in one side B of the first throttle body 80, that is, one side outer surface 80*b*. Further, secondly, a lower injection hole Ja of the first fuel injection valve J1 is arranged so as to be inclined toward a center of the first intake path 81. In other words, the first fuel injection valve J1 is arranged in such a manner that the first throttle body 80 exists in one side outer surface 80*b* and is inclined so as to lower the left side thereof in FIG. 23.

In this case, a first fuel distribution path 87*a* is provided through within the first fuel supply pipe 87, and a fuel inflow path 88 is connected to an opening in a left side C in FIG. 22 of the first fuel distribution path 87*a*.

Further, the fuel having the pressure increased by the fuel pump (not shown) is supplied to the fuel inflow path via a fuel pipe 89.

Reference numeral 90 denotes a second throttle body in which a second intake path 91 is provided through in a vertical direction in FIG. 23. The second intake path 91 is opened and closed by a second throttle valve 93 attached to a second throttle valve shaft 92.

An upper opening 91*a* of the second intake path 91 communicates with an inner side of the air cleaner box 84 arranged in an upper side via a duct or the like, a lower opening 91*b* of the second intake path 91 is connected to a second intake pipe 95 bent toward one side B in accordance with extending toward a lower side in FIG. 23, and a downstream side of the second intake pipe 95 is connected to a second cylinder 96, for example, constituting a V-type engine.

Reference symbol J2 denotes an electromagnetic type second fuel injection valve attached to the second throttle body 90. A lower side of the second fuel injection valve J2 is inserted and supported to the second throttle body 90, and an upper side thereof is inserted and supported to a second fuel supply pipe 97. The second fuel injection valve J2 is pinched by the second throttle body 90 and the second fuel supply pipe 97 by screw fixing the second fuel supply pipe 97 to the second throttle body 90 via the screw 88.

Further, it is necessary that the fuel injected by the second fuel injection valve J2 is supplied along a curve of the second intake pipe 95 as much as possible. Accordingly, the second fuel injection valve J2 is first arranged in the other side A of the second throttle body 90, that is, the other side outer surface 90*a*. Further, secondly, a lower injection hole Ja of the second fuel injection valve J2 is arranged so as to be inclined toward a center of the second intake path 91. In other words, the second fuel injection valve J2 is arranged in such a manner that the second throttle body 90 exists in the other side outer surface 90*a* and is inclined so as to lower the left side thereof in FIG. 23.

In this case, a second fuel distribution path 97*a* is provided through within the second fuel supply pipe 97.

As mentioned above, in the structure in which the respective cylinders are arranged in both sides of the intake path such as the V-type engine, the fuel injection valves are arranged so as to oppose in one side B and the other side A of the intake path in accordance therewith.

Further, the first throttle valve shaft 82 and the second throttle valve shaft 92 are arranged at the coaxial position in FIG. 22, a left end portion 82*c* of the first throttle valve shaft 82 is arranged so as to protrude to a left side C further from the left side outer surface 80*c* of the first throttle body 80, and a driven lever 98 is fixed to the left end portion 82*c*.

Further, a right end portion 92*d* of the second throttle valve shaft 92 is arranged so as to protrude to a right side D further from the right side outer surface 90*d* of the second throttle body 90, and a throttle drum 99 operated by a driver is fixed to the right end portion 92*d*.

Further, the throttle drum and the driven lever 98 arranged so as to oppose to the throttle drum 99 are connected so as to synchronously rotate by a synchronously connecting rod 100.

In this case, reference numeral 101 denotes a valve opening wire in which one end is engaged to the throttle drum 99 and the other end is engaged to an accelerator grip (not shown), and reference numeral 102 denotes a valve closing wire engaged in the same manner.

Accordingly, in the case that the driver pulls the valve opening wire 101, the throttle drum 99 is rotated in a clockwise direction in FIG. 23, and the rotation of the throttle drum 99 synchronously rotates the driven lever 98 via the synchronously connecting rod 100, whereby the first and second throttle valves 82 and 83 synchronously open the first and second intake paths 81 and 91.

Further, in the case that the driver pulls the valve closing wire 102, the throttle drum 99 is rotated in a counterclockwise direction in FIG. 23, and the rotation of the throttle drum 99 synchronously rotates the driven lever 98 via the synchronously connecting rod 100, whereby the first and second throttle valves 82 and 83 synchronously close the first and second intake paths 81 and 91.

Further, the first fuel distribution path 87*a* of the first fuel supply pipe 87 and the second fuel distribution path 97*a* of the second fuel supply pipe 97 are connected by a fuel communicating pipe 103.

The fuel communicating pipe 103 is connected to the second fuel distribution path 97*a* of the second fuel supply pipe 97 from the first fuel distribution path 87*a* of the first fuel supply pipe 87 while by passing an outer side of the right side D further from the right side outer surface 80*d* of the first throttle body 80 and an outer side of the other side A further from the other side outer surface 80*a* of the first throttle body 80.

In accordance with the conventional fuel supply apparatus mentioned above, when the driver operates the valve opening wire 101, the throttle drum 99 and the driven lever 98 are synchronously rotated in the clockwise direction, whereby the first throttle valve 83 opens the first intake path 81, and the second throttle valve 92 opens the second intake path 91. Further, in the case that the driver operates the valve closing wire 102, the throttle drum 99 and the driven lever 98 are synchronously rotated in the counterclockwise direction, whereby the first throttle valve 83 closes the first intake path 81 and the second throttle valve 92 closes the second intake path 91.

Further, the fuel having the pressure increased by the fuel pump (not shown) is supplied to the first fuel distribution path 87*a* within the first fuel supply pipe 87 via the fuel pipe 89 and the fuel inflow path 88, the fuel is injected toward the first intake pipe 85 from the injection hole Ja of the first fuel injection valve J1. In this case, since the first fuel injection valve J1 including the injection hole Ja is arranged in one side outer surface 80*b* of the first throttle body 80 in an inclined manner as mentioned above, it is possible to inject and supply the fuel injected from the injection hole Ja along the curve of the first intake pipe 85.

On the other hand, a part of the fuel existing within the first fuel distribution path 87*a* is supplied to the second fuel distribution path 97*a* of the second fuel supply pipe 97 via the fuel communicating path 103, and the fuel is injected toward the second intake pipe 95 from the injection hole Ja of the second fuel injection valve J2. In this case, since the second fuel injection valve J2 including the injection hole Ja is arranged in the other side outer surface 90*a* of the second throttle body 90 in the inclined manner as mentioned above, it is possible to inject and supply the fuel injected from the injection hole Ja along the second intake pipe 95.

In accordance with the conventional fuel supply apparatus mentioned above, the fuel communicating pipe 103 for communicating of the first fuel distribution path 87*a* of the first fuel supply pipe 87 and the second fuel distribution path 97*a* of the second fuel supply pipe 97 is arranged so as to bypass the one side B from the one side outer surface 80*b*, the right side D from the right side outer surface 80*d* and the other side A from the other side outer surface 80*a* of the first throttle body 80.

In other words, the first fuel distribution pipe 87*a* and the second fuel distribution path 97*a* communicates by the fuel communicating pipe 103 bypassing the outer side of the first throttle body 80 and the outer side of the second throttle body 90. The fuel communicating pipe 103 is arranged in the manner mentioned above because of the conditions that the air cleaner box 84 is arranged above the fuel communicating pipe 103 and thus the upper portion is limitedly used, that the first intake pipe 85 and the second intake pipe 95 are arranged below the fuel communicating pipe and thus the lower portion is limitedly used, and that the throttle drum 99 and the driven lever 98 are arranged in an adjacent space between the left side outer surface 80*c* of the first throttle body 80 and the right side outer surface 90*d* of the second throttle body 90, the valve opening wire 101 and the valve closing wire 102 are also arranged therein and thus the adjacent space is limitedly used.

In the case that the fuel communicating pipe 103 is arranged so as to bypass the outer sides of the throttle bodies 80 and 90 as mentioned above, the following problems are generated.

(1) There is a risk that a pipe length of the fuel communicating pipe 103 is elongated, the fuel communicating pipe 103 tends to be affected by a temperature of an ambient atmosphere of the engine, vapor is generated in the fuel flowing within the fuel communicating pipe, and the fuel injection particularly from the second fuel injection valve J2 lacks stability.

(2) Particularly in the case of being used as the fuel supply apparatus in which the receiving space of the apparatus is largely limited in comparison with a four-wheel vehicle, such as that for a two-wheel vehicle, there is a risk that the fuel communicating pipe 103 interferes with the other constituting members such as a frame, a tank or the like, so that a freedom of arranging the fuel pipe is deteriorated.

(3) Particularly in the case of being used in the structure in which the fuel supply apparatus is directly exposed to the exterior, such as that for the two-wheel vehicle, a protecting member is necessarily provided so as to prevent the fuel communicating pipe 103 and the passenger from being in contact with each other or prevent the fuel communicating pipe from being brought into contact with the other member, and there is a risk that the fuel communicating pipe exposes from the side portion of the two-wheel vehicle so as to deteriorate an outer appearance.

SUMMARY OF THE INVENTION

The present invention is made by taking the problems mentioned above into consideration, and a main object of the present invention is to inhibit vapor from being generated in fuel flowing within a fuel communicating pipe by making a pipe length of the fuel communicating pipe as short as possible, thereby improving a stability of fuel injected from a fuel injection valve, and the other object of the present invention is to provide a fuel supply apparatus which does not require any specific protecting member to the fuel communicating pipe, is improved in freedom of arranging the fuel communicating pipe, and is excellent particularly in mounting to a two-wheel vehicle.

In order to achieve the object mentioned above, in accordance with a first aspect of the present invention, there is provided a fuel supply apparatus comprising:

a first intake path extending through a first throttle body and a second intake path extending through a second throttle body, the first intake path and the second intake path being arranged in adjacent in a horizontal direction and arranged so as to be parallel in longitudinal axial lines of the respective intake paths;

a first throttle valve and a second throttle valve opening and closing the first and second intake paths, the first and second throttle valves being attached to a throttle valve shaft which is arranged so as to cut across the respective intake paths; and a first fuel injection valve arranged in one side outer surface of the first throttle body in such a manner that a lower injection hole is inclined toward a center of the first intake path, and a second fuel injection valve arranged in the other side outer surface of the second throttle body in such a manner that a lower injection hole is inclined toward a center of the second intake path, wherein the throttle valve shaft to which the first and second throttle valves are attached, is formed by one shaft and is arranged across toward the second intake path from the first intake path, and a throttle drum is fixedly arranged in a left end of the throttle valve shaft protruding from a left side outer surface of the second throttle body, wherein the first fuel injection valve is pinched by a first fuel supply body provided with a fuel inflow path and a first fuel distribution path, and by the first throttle body, and the second fuel injection valve is pinched by a second fuel supply body provided with a second fuel distribution path and the second throttle body, and wherein a fuel communicating pipe for communicating of the first fuel distribution path of the first fuel supply body and the second fuel distribution path of the second fuel supply body communicates via an adjacent space formed between opposing side surfaces of a left side outer surface of the first throttle body and a right side outer surface of the second throttle body in a horizontal direction thereof, and between an upper side of the throttle valve shaft and an upper end of each of the throttle bodies in a vertical direction thereof.

Further, in accordance with a second aspect of the present invention, there is provided a fuel supply apparatus as recited in the first aspect mentioned above, wherein the first fuel supply body is formed in parallel to the throttle valve shaft, a first injection valve insertion hole for inserting an upper portion of the first fuel injection valve and communicating with the first fuel distribution path, and a first attaching collar portion provided with a first attaching hole are formed near a right end thereof, a second attaching collar portion provided with a second attaching hole is formed near a left end thereof, and a first communicating joint insertion hole communicating with the first fuel distribution path is formed between the first and second attaching collar portions, wherein the second fuel supply body is formed in parallel to the throttle valve shaft, a second injection valve insertion hole for inserting an upper portion of the second fuel injection valve and communicating with the second fuel distribution path, and a first attaching collar portion provided with a first attaching hole are formed near a left end thereof, a second attaching collar portion provided with a second attaching hole is formed near a right end thereof, and a second communicating joint insertion hole communicating with the second fuel distribution path is formed between the first and second attaching collar portions, wherein the first fuel supply body is screwed with the first throttle body via the first attaching hole of the first attaching collar portion and is screwed with the second throttle body via the second attaching hole of the second attaching collar portion, the second fuel supply body is screwed with the second throttle body via the first attaching hole of the first attaching collar portion and is screwed with the first throttle body via the second attaching hole of the second attaching collar portion,.a first communicating joint is inserted to the first communicating joint insertion hole so as to be fixedly arranged in the first fuel supply body, and a second communicating joint is inserted to the second communicating joint insertion hole so as to be fixedly arranged in the second fuel supply body, and wherein the first communicating joint and the second communicating joint communicate by a fuel communicating pipe.

Further, in accordance with a third aspect of the present invention, there is provided a fuel supply apparatus as recited in the first aspect mentioned above, wherein any one of a right end and a left end of the second fuel distribution path of the second fuel supply body is open with an opening portion, and a pressure regulator is arranged in the opening portion.

Further, in accordance with a fourth aspect of the present invention, there is provided a fuel supply apparatus as recited in the second aspect mentioned above, wherein a lower end surface of the first attaching collar portion and a lower end surface of the second attaching collar portion formed in the first fuel supply body are formed at the same angle of incline in a cross section orthogonal to the first fuel distribution path, and wherein a lower end surface of the first attaching collar portion and a lower end surface of the second attaching collar portion formed in the second fuel supply body are formed at the same angle of incline in a cross section orthogonal to the second fuel distribution path.

Further, in accordance with a fifth aspect of the present invention, there is provided a fuel supply apparatus as recited in the first aspect mentioned above, wherein a first sub throttle valve and a second sub throttle valve are arranged in first and second intake paths in an upstream side of the first and second throttle valves of the first and second throttle bodies, wherein the first sub throttle valve and the second sub throttle valve are attached to a second throttle valve shaft constituted by one shaft cutting across to the second intake path from the first intake path, and wherein the fuel communicating pipe communicates via an adjacent space formed between opposing side surfaces of a left side outer surface of the first throttle body and a right side outer surface of the second throttle body in a horizontal direction thereof and between an upper side of the throttle valve shaft and a lower side of the second throttle valve shaft in a vertical direction thereof.

In accordance with the first aspect of the present invention, since the throttle valve shaft is formed by one shaft and is arranged across from the first intake path toward the second intake path, and the throttle drum is arranged in the left end of the throttle valve shaft protruding from the left side outer surface of the second throttle body, the-space in the horizontal direction is formed between the left side outer surface of the first throttle body and the right side outer surface of the second throttle body, the space in the vertical direction is formed between the upper side of the throttle valve shaft and the upper end of each of the throttle bodies, and the adjacent space is formed by the space in the horizontal direction and the space in the vertical direction. Further, the fuel communicating pipe for communicating of the first fuel distribution path of the first fuel supply body pinching the first fuel injection valve, and the second fuel distribution path of the second fuel supply body pinching the second fuel injection valve is arranged within the adjacent space.

In accordance with the structure mentioned above, the fuel communicating pipe can connect the first fuel distribution path and the second fuel distribution path at the shortest length, and can inhibit the fuel communicating pipe from being heated up by the temperature of the ambient atmosphere of the engine, whereby it is possible to inhibit the vapor from being generated in the fuel flowing toward the second fuel distribution path from the first fuel distribution path via the fuel communicating pipe, and it is possible to continuously supply the stable fuel from the second fuel injection valve.

Further, it is possible to improve the freedom of arranging the fuel communicating pipe.

Further, since the fuel communicating pipe is protected by the cleaner box in the upper side thereof, is protected by the intake pipes and the throttle valve shaft in the lower side, and is protected by the first and second throttle bodies in the horizontal direction, no specific protecting member for protecting the fuel communicating pipe is required. Further, since the fuel communicating pipe does not interfere with the driver of the two-wheel vehicle and the fuel communicating pipe is not exposed toward the exterior, it is possible to improve an outer appearance of the two-wheel vehicle.

In accordance with the second aspect of the present invention, the right end of the first fuel supply body formed in parallel to the throttle valve shaft is screwed with the first throttle body via the first attaching hole of the first attaching collar portion, and the left end is screwed with the second throttle body via the second attaching hole of the second attaching collar portion.

Further, the left end of the second fuel supply body formed in parallel to the throttle valve shaft is screwed with the second throttle body via the first attaching hole of the first attaching collar portion, and the right end is screwed with the first throttle body via the second attaching hole of the second attaching collar portion, whereby it is possible to firmly fasten the first and second fuel supply bodies to the first and second throttle bodies.

Accordingly, when connecting the first communicating joint and the second communicating joint arranged between the first and second attaching collar portions via the fuel communicating pipe, any gap being generated with respect to the upper portion of the first fuel injection valve inserted into the first injection valve insertion hole and the upper portion of the second fuel injection valve inserted into the second injection valve insertion hole due to deflection of the first and second fuel supply bodies is prevented.

In accordance with the third aspect of the present invention, since the pressure regulator is arranged in the opening portion of the second fuel distribution path, no novel member is required for fixing the pressure regulator, and it is possible to effectively make good use of the opening portion in one end side which is always necessary at a time of forming the second fuel distribution path.

Further, since the pressure regulator is attached near the second attaching collar portion, the second fuel supply body does not wobble even at a time when an external force is applied to the pressure regulator.

In accordance with the fourth aspect of the present invention, since the lower end surface of the first attaching collar portion and the lower end surface of the second attaching collar portion are formed at the same angle of incline, it is possible to accurately attach the first and second fuel supply bodies to the first and second throttle bodies, and it is particularly possible to accurately insert and arrange the upper portion of each of the fuel injection valves within each of the injection valve insertion holes at a uniform annular gap.

In accordance with the fifth aspect of the present invention, since the space in the vertical direction of the adjacent space is formed between the upper side of the throttle valve shaft and the lower side of the second throttle valve shaft, and the fuel communicating pipe is arranged in the adjacent space, it is possible to apply to the fuel supply apparatus provided with the first and second sub throttle valves, and the second throttle valve shaft also serves to protect the upper portion of the fuel communicating pipe.

DESCRIPTION OF THE PREFERRED EMBODIMENTS

A description will be given below of an embodiment of a fuel supply apparatus in accordance with the present invention.

Figure 1:
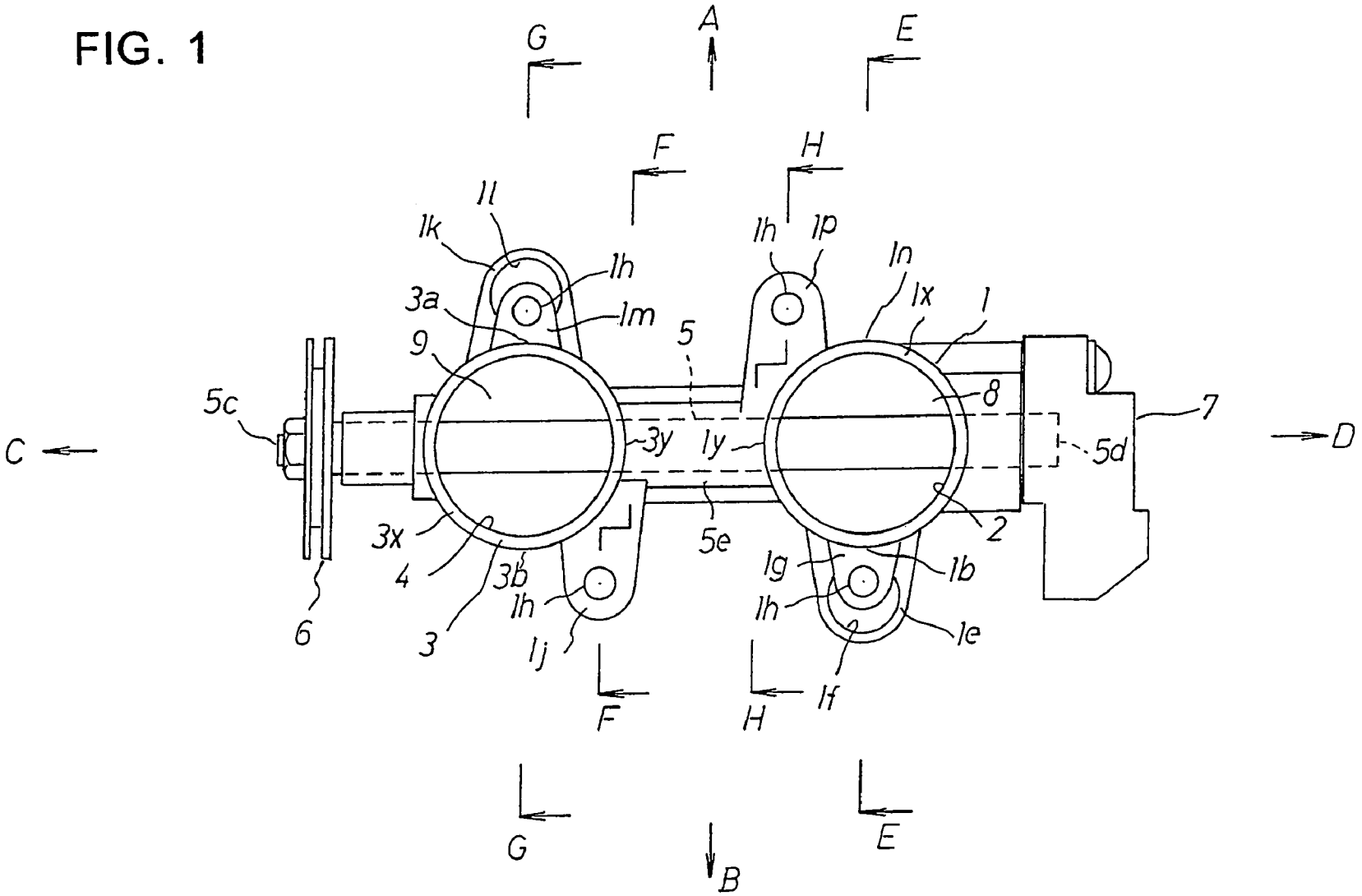
FIG. 1 is a plan view of an upper portion of a throttle body used in the present invention.
Figure 2:
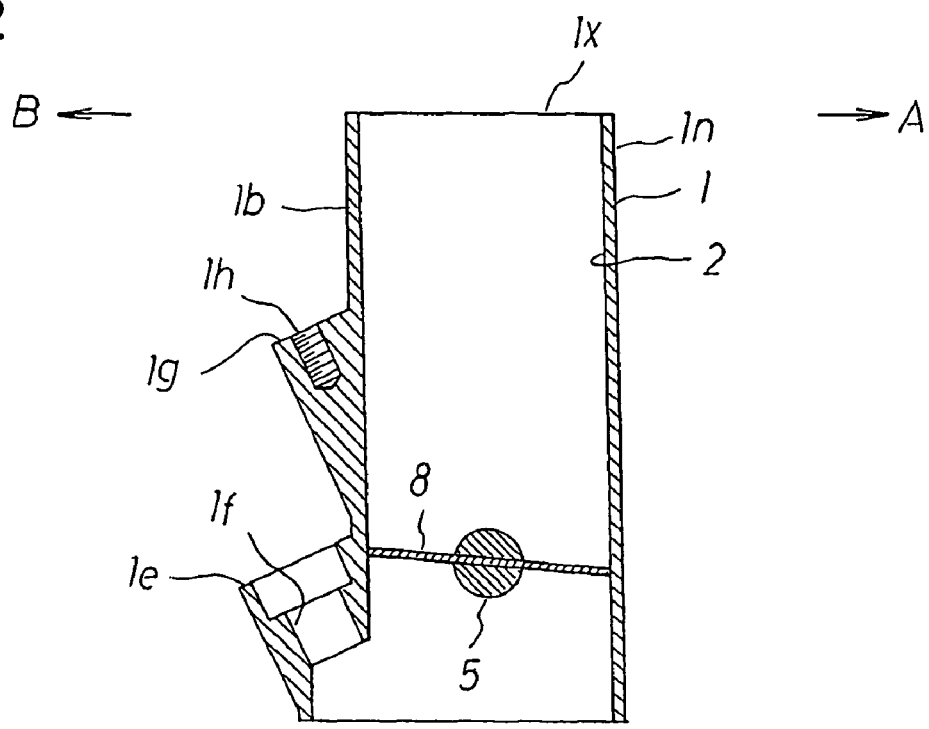
FIG. 2 is a vertical cross sectional view along a line E—E in FIG. 1.
Figure 3:
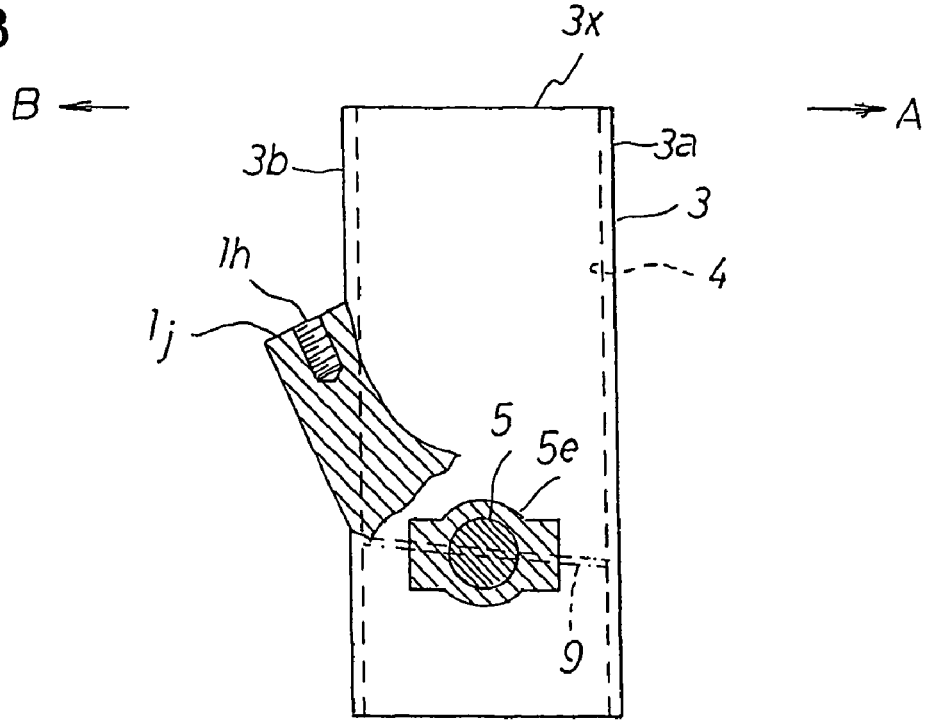
FIG. 3 is a vertical cross sectional view along a line F—F in FIG. 1.
Figure 4:
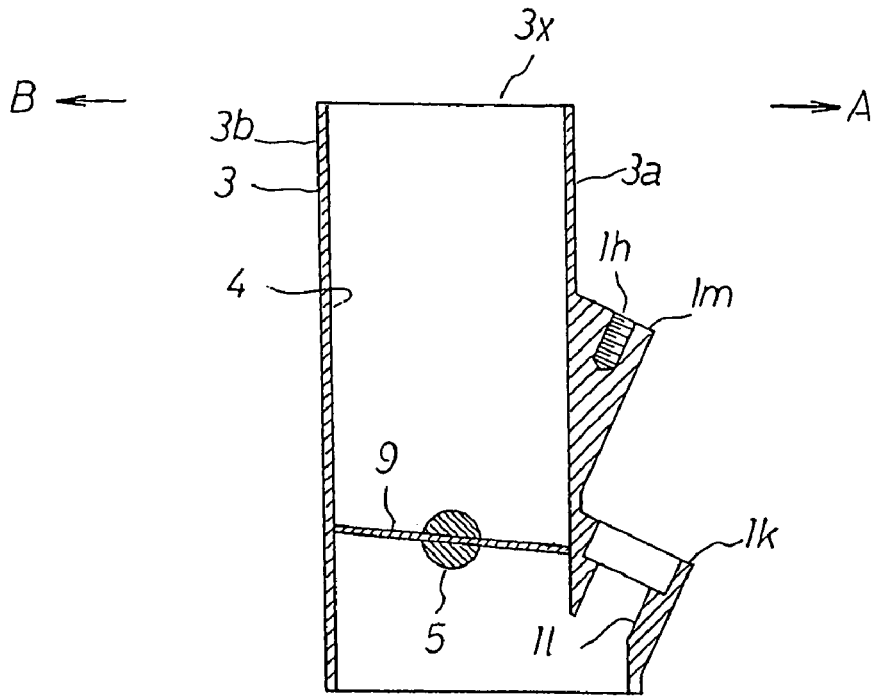
FIG. 4 is a vertical cross sectional view along a line G—G in FIG. 1.
Figure 5:
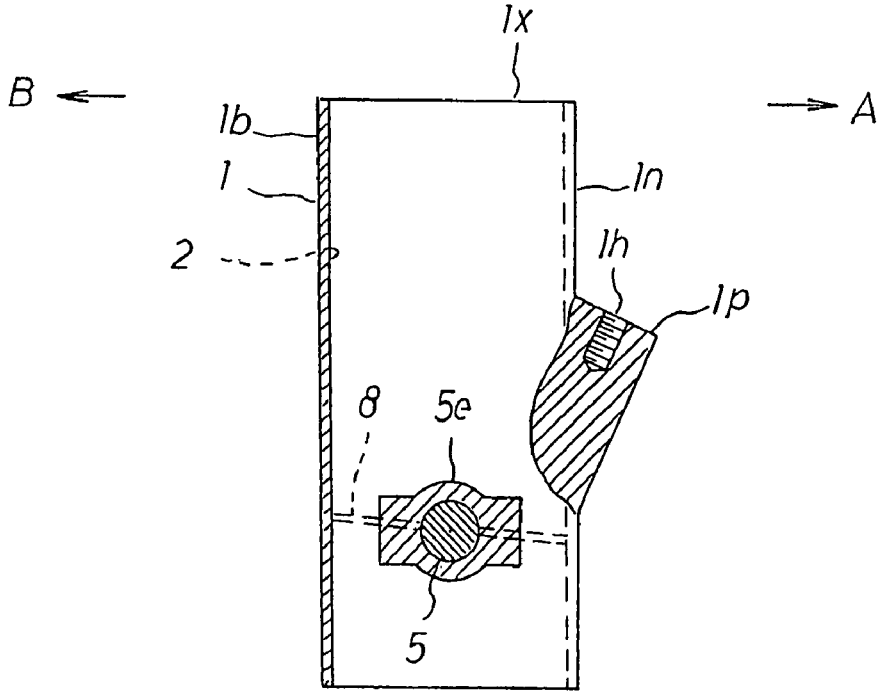
FIG. 5 is a vertical cross sectional view along a line H—H in FIG. 1.

FIG. 1 is a plan view of an upper portion of a throttle body, FIG. 2 is a vertical cross sectional view along a line E—E in FIG. 1, FIG. 3 is a vertical cross sectional view along a line F—F in FIG. 1, FIG. 4 is a vertical cross sectional view along a line G—G in FIG. 1, and FIG. 5 is a vertical cross sectional view along a line H—H in FIG. 1.

Reference numeral 1 denotes a first throttle body in which a first intake path 2 is provided through in a vertical direction. A first injection valve inclined end surface 1*e* is formed in one side outer surface 1*b* of the first throttle body 1, whereby a first injection valve support hole 1*f* is provided through in an oblique direction toward a center of the first intake path 2.

Further, a first supply body inclined end surface 1*g* is formed in the one side outer surface 1*b* of the first throttle body 1 at an upper position than the first injection valve inclined end surface 1*e*, whereby a female screw hole 1*h* is provided in an oblique direction toward the center of the first intake path 2.

Reference numeral 3 denotes a second throttle body in which a second intake path 4 is provided through in a vertical direction. The first intake path 2 and the second intake path 4 are arranged in adjacent in a horizontal direction in FIG. 1, and longitudinal axial lines of the respective intake paths 2 and 4 are arranged in parallel.

Further, a first supply body inclined end surface 1*j* is formed in one side outer surface 3*b* of the second throttle body 3, whereby a female screw hole 1*h* is provided in an oblique direction toward a center of the second intake path 4.

The first supply body inclined end surface 1*g*, the first injection valve inclined end surface 1*e* and the first supply body inclined end surface 1*j* are inclined so as to lower the left side thereof in FIGS. 2 and 3, and are formed so as to have the same angle of incline.

Further, the first supply body inclined end surfaces 1*g* and 1*j* are formed at the same position in a vertical direction and a horizontal direction in FIGS. 2 and 3.

As shown in FIG. 4, a second injection valve inclined end surface 1*k* is formed in the other side outer surface 3*a* of the second throttle body 3, whereby a second injection valve support hole 11 is provided in an oblique direction toward the center of the second intake path 4.

Further, a second supply body inclined end surface 1*m* is formed in the other side outer surface 3*a* of the second throttle body 3 at an upper position than the second injection valve inclined end surface 1*k*, whereby the female screw hole 1*h* is provided in an oblique direction toward the center of the second intake path 4.

As shown in FIG. 5, a second supply body inclined end surface 1*p* is formed in the other side outer surface 1*n* of the first throttle body 1, whereby the female screw hole 1*h* is provided in an oblique direction toward the center of the first intake path 2.

The second supply body inclined end surface 1*m*, the second injection valve inclined end surface 1*k* and the second supply body inclined end surface 1*p* are inclined so as to lower the right side thereof in FIGS. 4 and 5, and are formed so as to have the same angle of incline.

Further, the second supply body inclined end surfaces 1*m* and 1*p* are formed at the same position in a vertical direction and a horizontal direction in FIGS. 4 and 5.

Reference numeral 5 denotes a throttle valve shaft cutting across the first intake path 2 and the second intake path 4 in the horizontal direction in FIG. 1 and constituted by one shaft rotatably supported to the first throttle body 1 and the second throttle body 3, a throttle drum 6 operated by a driver is attached to a left end 5*c* of the throttle valve shaft 5 protruding to a left side from the second throttle body 3, and an angle sensor 7 detecting an angle of rotation of the throttle valve shaft 5 is attached to a right end 5*d* of the throttle valve shaft 5 protruding to a right side from the first throttle body 1.

Further, a first throttle valve 8 is attached to the throttle valve shaft 5 arranged within the first intake path 2, a second throttle valve 9 is attached to the throttle valve shaft 5 arranged within the second intake path 4, and the first intake path 2 and the second intake path 4 are controlled so as to be synchronously opened and closed by the first throttle valve 8 and the second throttle valve 9.

Further, the first throttle body 1 and the second throttle body 3 are connected by a connecting boss including a bearing boss 5*e* surrounding an outer periphery of the throttle valve shaft 5.

In this case, a valve opening wire and a valve closing wire are engaged to the throttle drum 6 in the same manner as the conventional one.

As mentioned above, the first intake path 2 extending in the first throttle body 1 and the second intake path 4 extending in the second throttle body 3are arranged in adjacent in the horizontal direction, longitudinal axial lines of the respective intake paths 2 and 4 are arranged in parallel, and the throttle valve shaft constituted by one shaft is arranged so as to cut across the centers of the first and second intake paths 2 and 4 in the horizontal direction.

Further, the first supply body inclined end surface 1*g* and the first injection valve inclined end surface 1*e* provided with the first injection valve support hole 1*f* are formed in one side B of the first throttle body 1, and the second supply body inclined end surface 1*p* is formed in the other side A.

Further, the first supply body inclined end surface 1*j* is formed in one side B of the second throttle body 3, and the second supply body inclined end surface 1*m* and the second injection valve inclined end surface 1*k* provided with the second injection valve support hole 11 are formed in the other side A.

Next, a description will be given of a fuel supply body. A first fuel supply body 10 and a second fuel supply body 11 are prepared as the fuel supply body.

A description will be given of the first fuel supply body 10 with reference to FIGS. 6 to 9.

Figure 6:
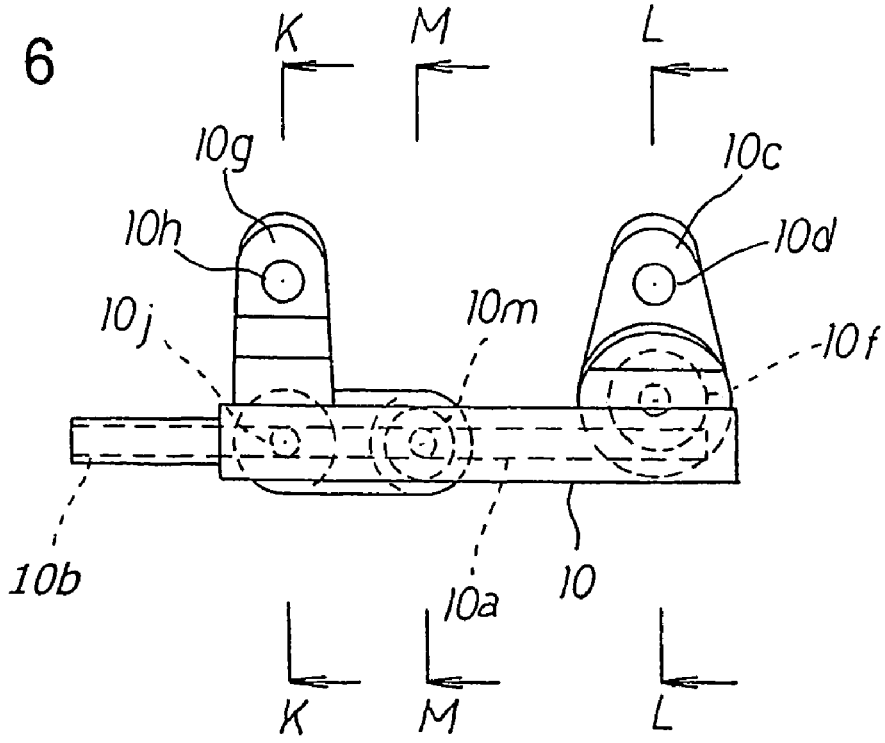
FIG. 6 is a plan view of an upper portion of a first fuel supply body used in the present invention.
Figure 7:
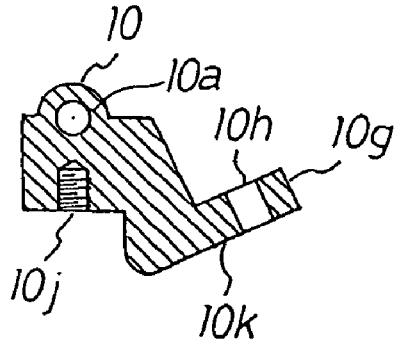
FIG. 7 is a vertical cross sectional view along a line K—K in FIG. 6.
Figure 8:
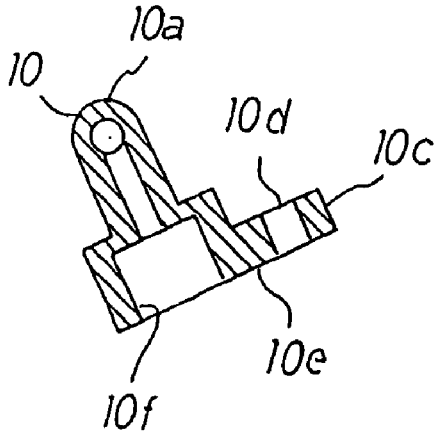
FIG. 8 is a vertical cross sectional view along a line L—L in FIG. 6.
Figure 9:
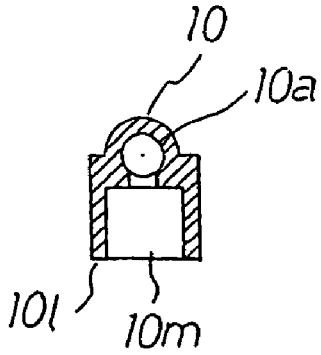
FIG. 9 is a vertical cross sectional view along a line M—M in FIG. 6.

FIG. 6 is a plan view of an upper portion of the first fuel supply body, FIG. 7 is a vertical cross sectional view along a line K—K in FIG. 6, FIG. 8 is a vertical cross sectional view along a line L—L in FIG. 6, and FIG. 9 is a vertical cross sectional view along a line M—M in FIG. 6.

The first fuel supply body 10 is structured such that a first fuel distribution path 10*a* extending in a horizontal direction in FIG. 6 is provided in an inner portion thereof, and a fuel inflow path 10*b* open toward a left side is formed in a left end thereof.

Further, a first attaching collar portion 10*c* extending toward a right side in FIG. 8 is formed near a right end of the first fuel supply body 10, a first attaching hole 10*d* is provided in a leading end portion thereof, and a first injection valve insertion hole 10*f* communicating with the first fuel distribution path 10*a* is formed toward an upper side in a lower end surface 10*e* of the first attaching collar portion 10*c*.

Further, a second attaching collar portion 10*g* extending toward a right side in FIG. 7 is formed near a left end of the first fuel supply body 10, a second attaching hole 10*h* is provided in a leading end portion thereof, and a female screw hole 10*j* is formed toward an upper side in a lower center portion thereof.

Further, both of the lower end surface 10*e* of the first attaching collar portion 10*c* and the lower end surface 10*k* of the second attaching collar portion log are formed as the inclined surface, and are formed so as to lower the left side thereof in FIGS. 7 and 8 and at the same angle of incline.

(The angle of incline is equal to the angle of incline of the first supply body inclined end surface 1*g* of the first throttle body 1, and the first supply body inclined end surface 1*j* of the second throttle body 3.)

Further, as shown in FIG. 9, a first communicating joint insertion hole 10*m* which communicates with the first fuel distribution path 10*a in* an upper side and is open toward a lower end 101 is formed between the first attaching collar portion 10*c* and the second attaching collar portion 10*g*.

Figure 10:
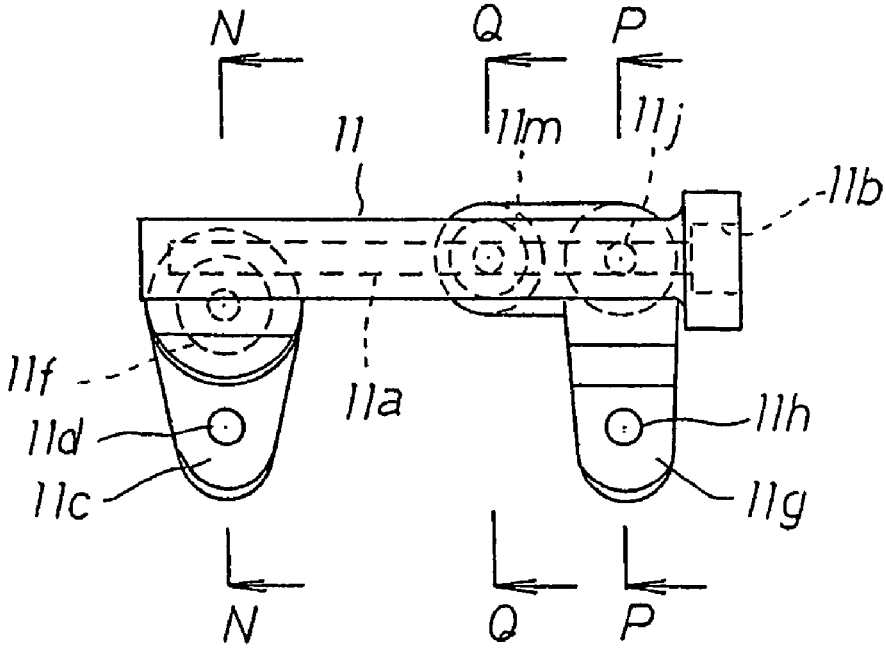
FIG. 10 is a plan view of an upper portion of a second fuel supply body used in the present invention.

A description will be given of the second fuel supply body 11 with reference to FIGS. 10 to 13. FIG. 10 is a plan view of an upper portion of a second fuel supply body, FIG. 11 is a vertical cross sectional view along a line P—P in FIG. 10, FIG. 12 is a vertical cross sectional view along a line N—N in FIG. 10, and FIG. 13 is a vertical cross sectional view along a line Q—Q in FIG. 10.

The second fuel supply body 11 is structured such that a second fuel distribution path 11*a* extending in a horizontal direction in FIG. 10 is provided in an inner portion thereof, and a right end thereof is open to a right side with an opening portion 11*b*.

Figure 12:
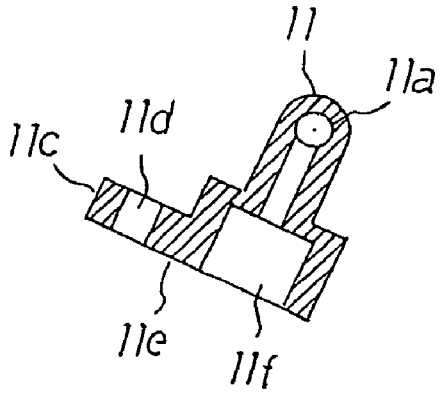
FIG. 12 is a vertical cross sectional view along a line N—N in FIG. 10.
Figure 13:
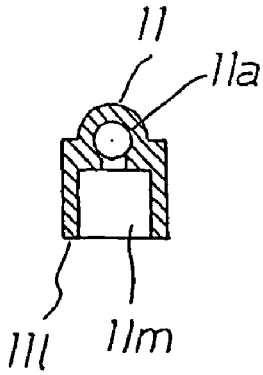
FIG. 13 is a vertical cross sectional view along a line Q—Q in FIG. 10.

Further, a first attaching collar portion 11*c* extending toward a left side in FIG. 12 is formed near a left end of the second fuel supply body 11, a first attaching hole lid is provided in a leading end portion thereof, and a second injection valve insertion hole 11*f* communicating with the second fuel distribution path 11*a* is formed toward an upper side in a lower end surface 11*e* of the first attaching collar portion 11*c*.

Figure 11:
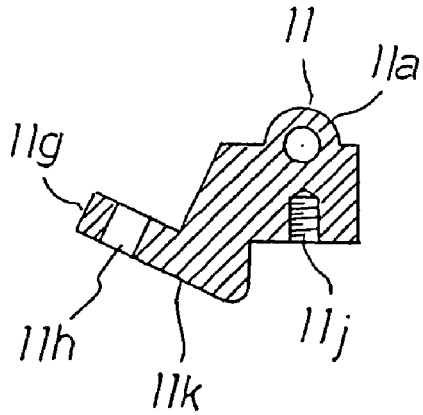
FIG. 11 is a vertical cross sectional view along a line P—P in FIG. 10.

Further, a second attaching collar portion 11*g* extending toward a left side in FIG. 11 is formed near a right end of the second fuel supply body 11, a second attaching hole 11*h* is provided in a leading end portion thereof, and a female screw hole 11*j* is formed toward an upper side in a lower center portion thereof.

Further, both of the lower end surface 11*e* of the first attaching collar portion 11*c* and the lower end surface 11*k* of the second attaching collar portion 11*g* are formed as the inclined surface, and are formed so as to lower the right side thereof in FIGS. 11 and 12 and at the same angle of incline. (The angle of incline is equal to the angle of incline of the second supply body inclined end surface 1*p* of the first throttle body 1, and the second supply body inclined end surface 1*m* of the second throttle body 3.)

Further, as shown in FIG. 13, a second communicating joint insertion hole 11*m* which communicates with the second fuel distribution path 11*a* in an upper side and is open toward a lower end 11*l* is formed between the first attaching collar portion 11*c* and the second attaching collar portion 11*g*.

Next, a description will be given of a communicating joint with reference to FIGS. 14 and 15.

Figure 14:
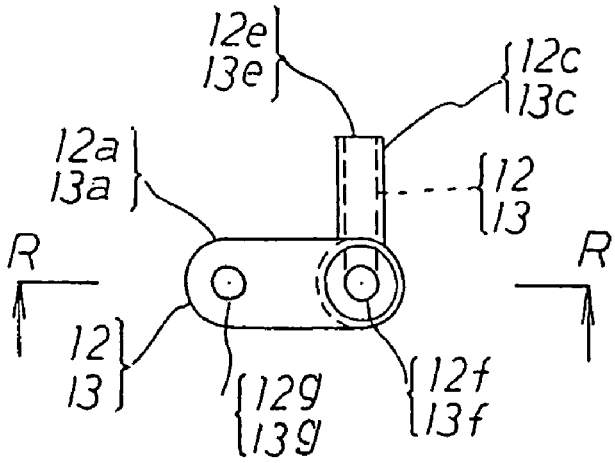
FIG. 14 is a plan view of an upper portion of a communicating joint used in the present invention.
Figure 15:
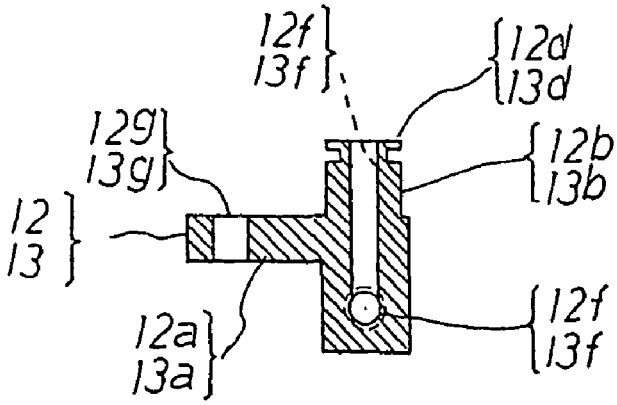
FIG. 15 is a vertical cross sectional view along a line R—R in FIG. 14.

FIG. 14 is a plan view of an upper portion of the communicating joint, and FIG. 15 is a vertical cross sectional view along a line R—R in FIG. 14.

A first communicating joint 12 has a first attaching collar portion 12*a*, a first insertion protruding portion 12*b* is formed so as to protrude toward an upper side from a right end of the first attaching collar portion 12*a*, a first joint portion 12*c* extending toward a side portion (an upper side in FIG. 14) is formed in a lower side of the first insertion protruding portion 12*b*, and a first flow path 12*f* is provided toward an end portion 12*e* of the first joint portion 12*c* from an end portion 12*d* of the first insertion protruding portion 12*b*.

Further, an attaching hole 12*g* is provided in a left end of the first attaching collar portion 12*a*.

In this case, while a second communicating joint 13 which is absolutely the same as the first communicating joint 12 is prepared, structures and reference numerals of respective portions of the first communicating joint 12 are used to those of the second communicating joint 13 by changing the word of first and the numeral of 12 to second and 13 respectively, in order to make a description at a time of being assembled easy. (For example, a second attaching collar portion, a second insertion protruding portion and a second flow path of the second communicating joint 13 are called as a second attaching collar portion 13*a*, a second insertion protruding portion 13*b* and a second flow path 13*f*.)

The fuel supply apparatus is formed by assembling the structures mentioned above in accordance with the following manner.

First, the first fuel supply body 10 is assembled with the first and second throttle bodies 1 and 3 in accordance with the following way.

The lower end surface 10*e* of the first attaching collar portion 10*c* of the first fuel supply body 10 is arranged in a contact manner on the first supply body inclined end surface 1*g* of the first throttle body 1, the lower portion Ja of the first fuel injection valve Ji is arranged so as to be inserted into the first injection valve support hole 1*f*, and the upper portion Jb of the first fuel injection valve J1 is arranged so as to be inserted into the first injection valve insertion hole 10*f* of the first fuel supply body 10. (This state is disclosed in FIG. 17 corresponding to a cross section along a line S—S in FIG. 16.)

On the other hand, the lower end surface 10*k* of the second attaching collar portion log of the first fuel supply body 10 is arranged on the first supply body inclined end surface 1*j* of the second throttle body 3. (This state is disclosed in FIG. 18 corresponding to a cross section along a line T—T in FIG. 16.)

Further, in this state, a screw 14 is inserted into the first attaching hole 10*d* of the first attaching collar portion 10*c* and the screw 14 is screwed toward the female screw hole 1*h* open to the first supply body inclined end surface 1*g*. On the other hand, the screw 14 is inserted into the second attaching hole 10*h* of the second attaching collar portion 10*g* and the screw 14 is screwed toward the female screw hole 1*h* open to the second supply body inclined end surface 1*j*. In accordance with the structure mentioned above, the right end of the first fuel supply body 10 is fixed to the one side outer surface 1*b* of the first throttle body 1 via the first attaching collar portion 10*c*, and the left end of the first fuel supply body 10 is fixed to the one side outer surface 3*b* of the second throttle body 3 via the second attaching collar portion log, whereby the first fuel supply body 10 is arranged so as to be firmly fixed to the one side B of the throttle body.

Further, at this time, the upper portion Jb of the first fuel injection valve J1 is inserted into and supported by the first injection valve insertion hole 10*f* of the first fuel supply body 10, the lower portion Ja is inserted into and supported by the first injection valve support hole 1*f* of the first throttle body 1, and the first fuel injection valve J1 is pinched by the first throttle body 1 and the first fuel supply body 10.

Next, the second fuel supply body 11 is assembled with the first and second throttle bodies 1 and 3 in accordance with the following way.

Figure 16:
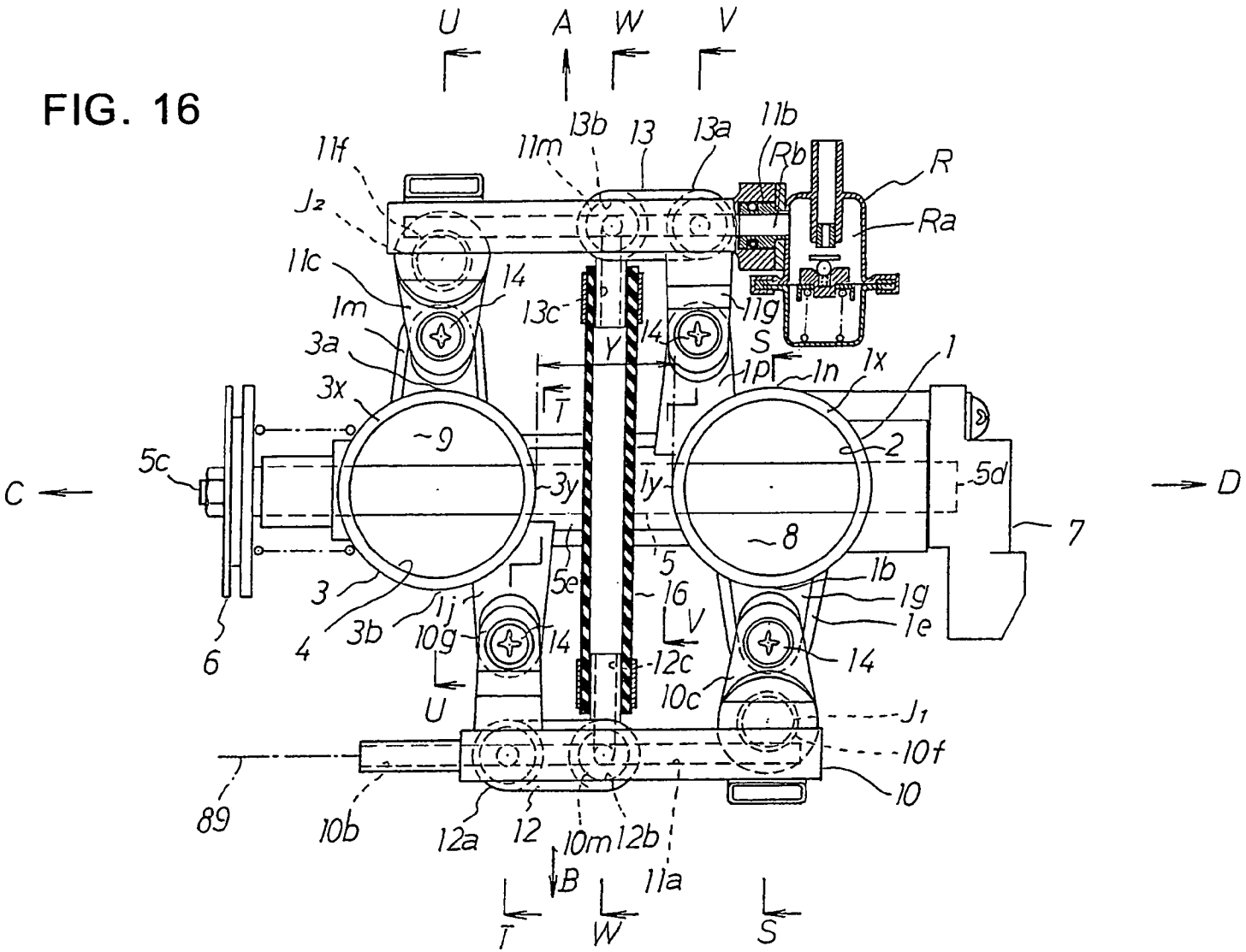
FIG. 16 is a plan view of an upper portion showing an embodiment of a fuel supply apparatus in accordance with the present invention.
Figure 17:
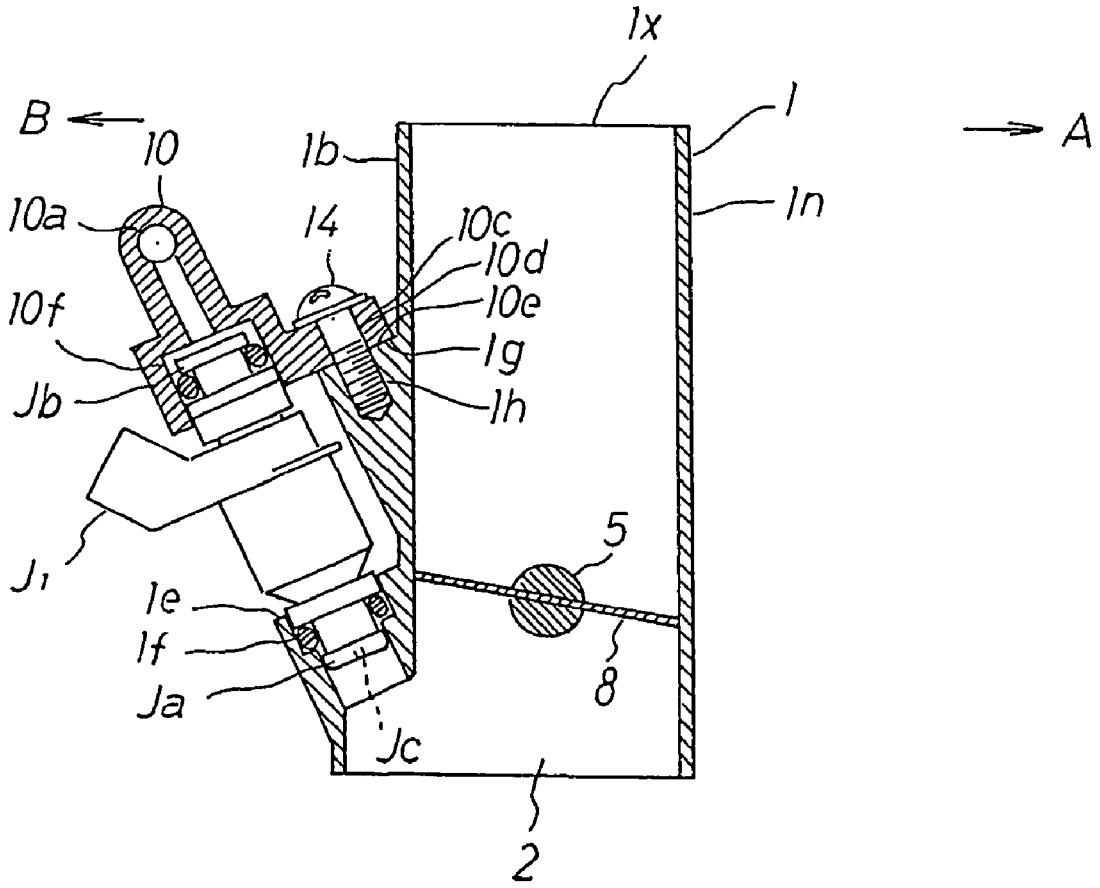
FIG. 17 is a vertical cross sectional view along a line S—S in FIG. 16.
Figure 19:
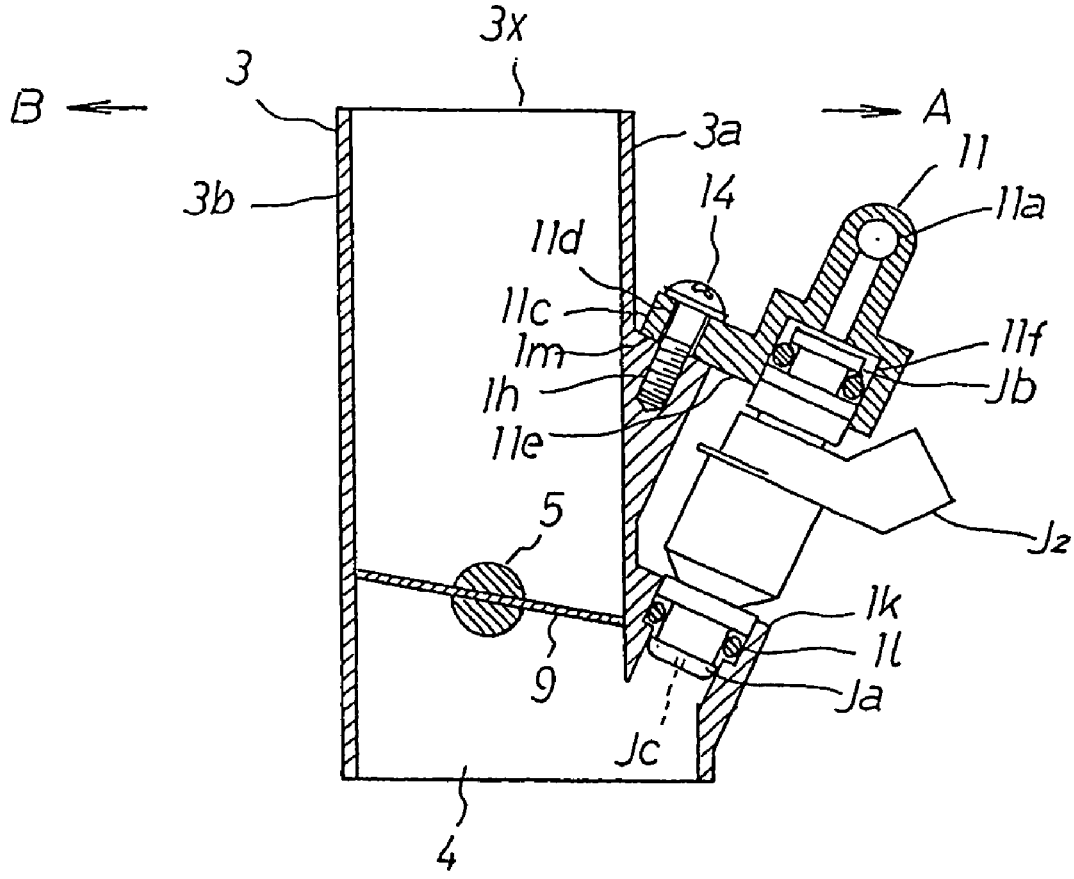
FIG. 19 is a vertical cross sectional view along a line U—U in FIG. 16.

The lower end surface 11*e* of the first attaching collar portion 11*c* of the second fuel supply body 11 is arranged in a contact manner on the second supply body inclined end surface 1*m* of the second throttle body 3, the lower portion Ja of the second fuel injection valve J2 is arranged so as to be inserted into the second injection valve support hole 11, and the upper portion Jb of the second fuel injection valve J2 is arranged so as to be inserted into the second injection valve insertion hole 11*f* of the second fuel supply body 11 (This state is disclosed in FIG. 19 corresponding to a cross section along a line U—U in FIG. 16.)

On the other hand, the lower end surface 11*k* of the second attaching collar portion 11*g* of the second fuel supply body 11 is arranged on the second supply body inclined end surface 1*p* of the first throttle body 1. (This state is disclosed in FIG. 20 corresponding to a cross section along a line V—V in FIG. 16.)

Further, in this state, the screw 14 is inserted into the first attaching hole 11*d* of the first attaching collar portion 11*c* and the screw 14 is screwed toward the female screw hole 1*h* open to the second supply body inclined end surface 1*m*. On the other hand, the screw 14 is inserted into the second attaching hole 11*h* of the second attaching collar portion 11*g* and the screw 14 is screwed toward the female screw hole 1*h* open to the second supply body inclined end surface 1*p*.

In accordance with the structure mentioned above, the left end of the second fuel supply body 11 is fixed to the other side outer surface 3*a* of the second throttle body 3 via the first attaching collar portion 11*c*, and the right end of the second fuel supply body 11 is fixed to the other side outer surface 1*n* of the first throttle body 1 via the second attaching collar portion 1*g*, whereby the second fuel supply body 11 is arranged so as to be firmly fixed to the other side A of the throttle body.

Further, at this time, the upper portion Jb of the second fuel injection valve J2 is inserted into and supported by the second injection valve insertion hole 11*f* of the second fuel supply body 11, the lower portion Ja is inserted into and supported by the second injection valve support hole 11 of the second throttle body 3, and the second fuel injection valve J2 is pinched by the second throttle body 3 and the first fuel supply body 11.

Next, the first insertion protruding portion 12*b* of the first communicating joint 12 is inserted into the first communicating joint insertion hole 10*m* of the first fuel supply body 10, the screw 14 is inserted into the attaching hole 12*g*, and the screw 14 is screwed toward the female screw hole 10*j* open to the lower side of the first fuel supply body 10.

In accordance with the structure mentioned above, the first communicating joint 12 is firmly fixed to the lower surface of the first fuel supply body 10, and the first insertion protruding portion 12*b* is arranged so as to be fixed within the first communicating joint insertion hole 10*m*.

Figure 18:
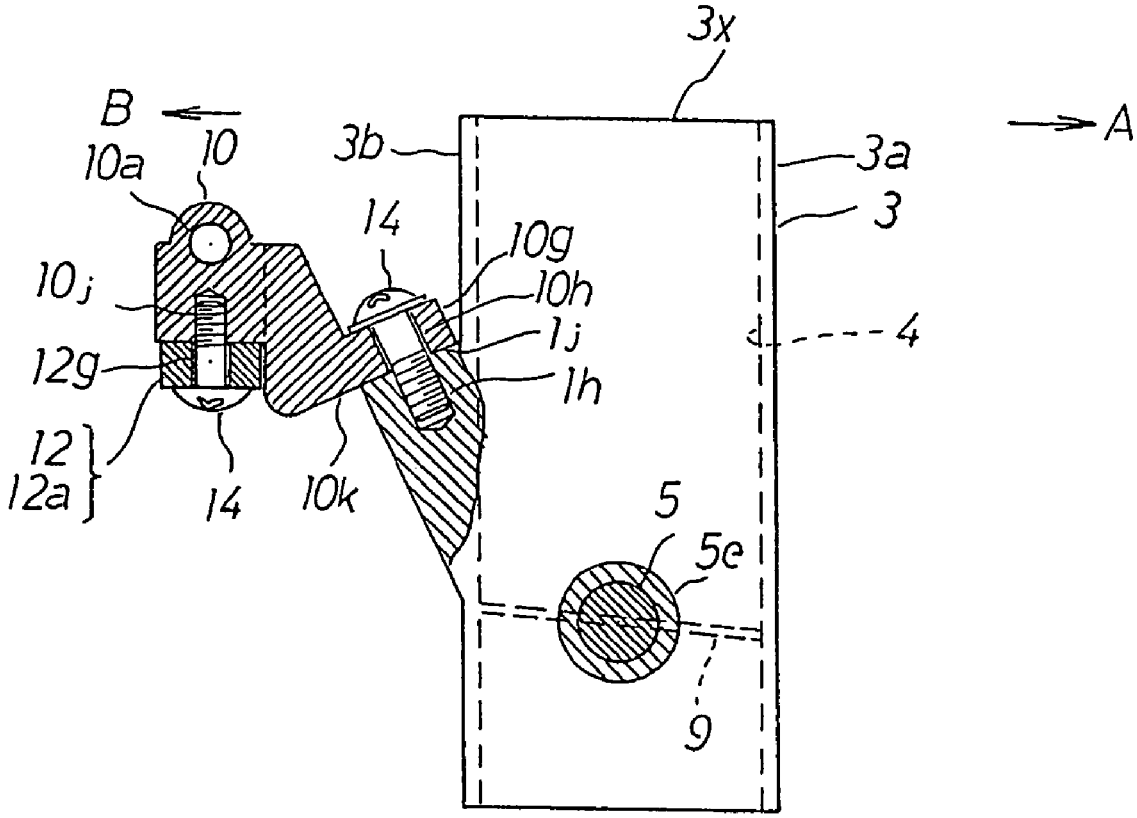
FIG. 18 is a vertical cross sectional view along a line T—T in FIG. 16.
Figure 21:
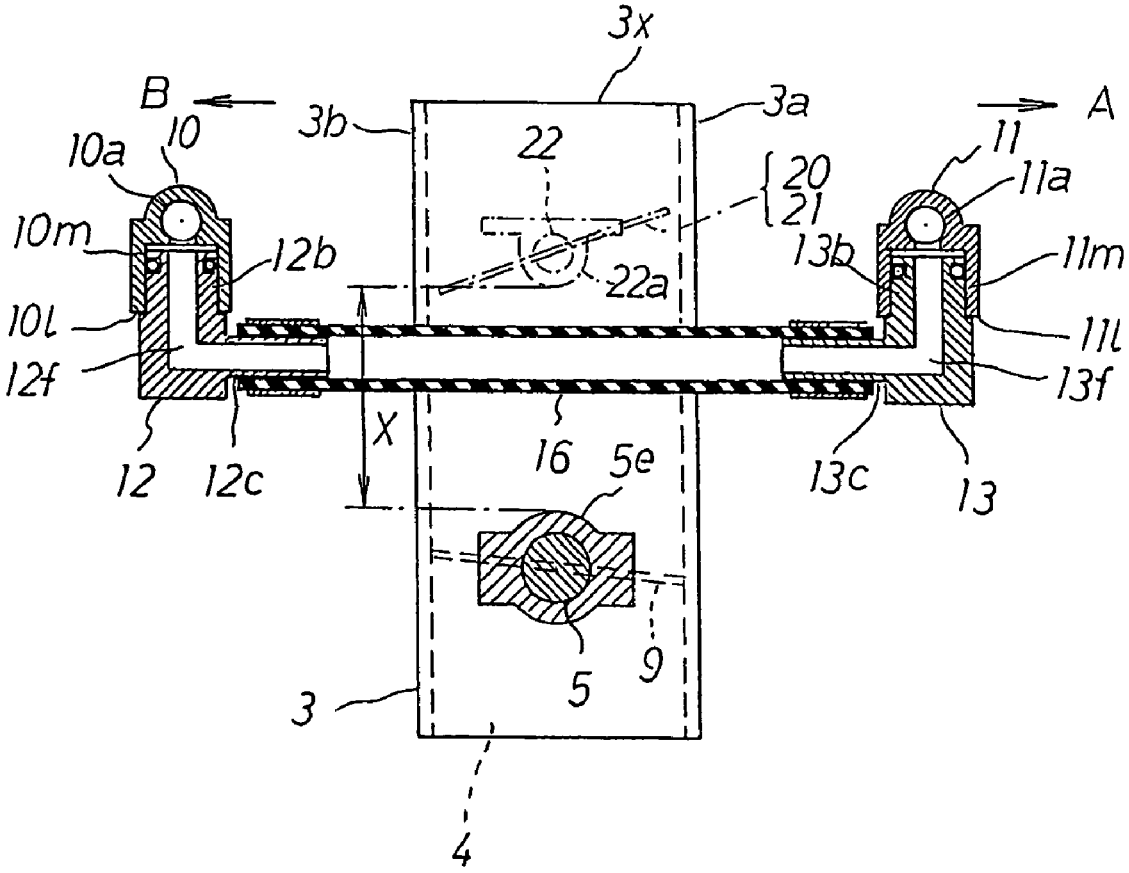
FIG. 21 is a vertical cross sectional view along a line W—W in FIG. 16.
Figure 22:
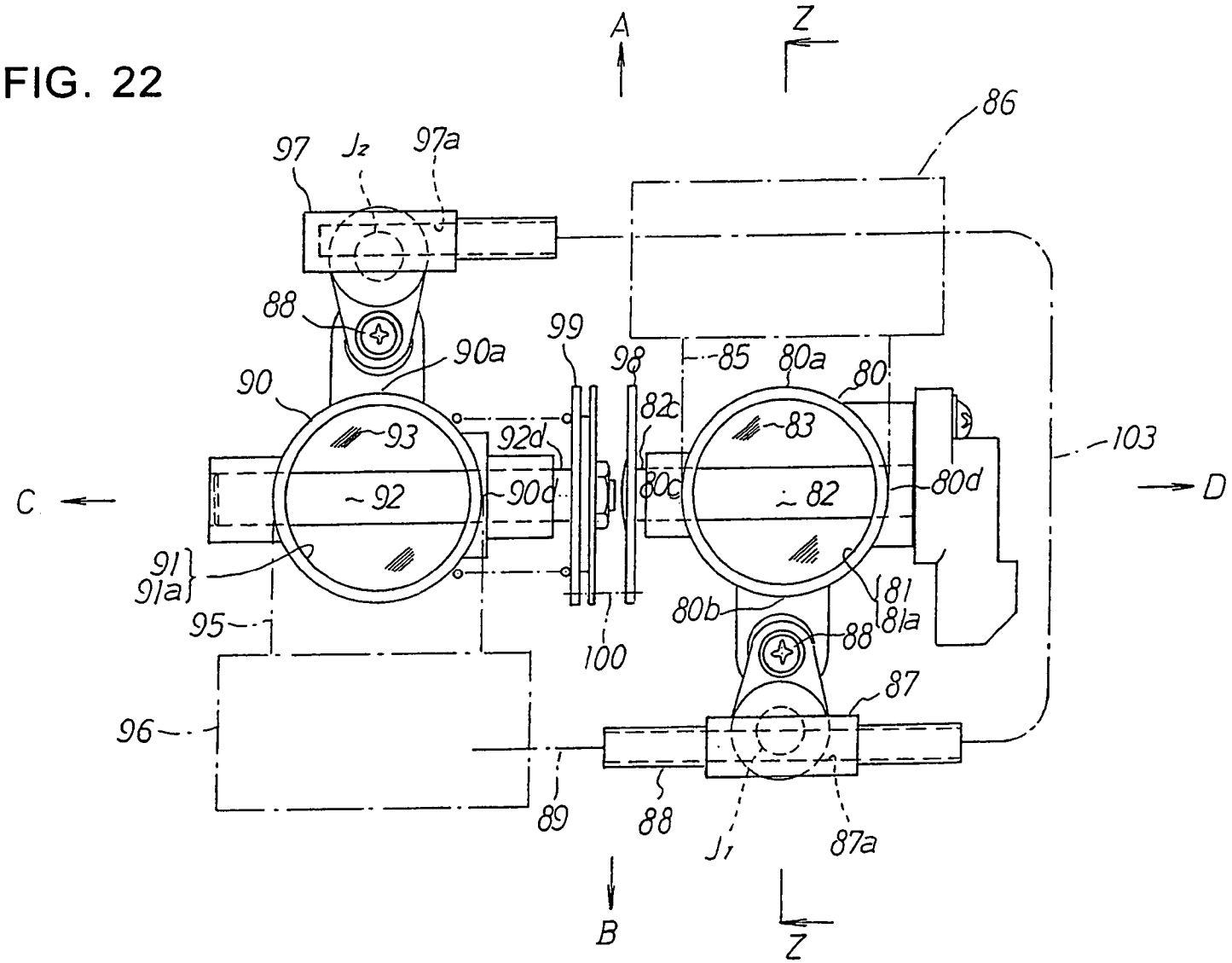
FIG. 22 is a plan view of an upper portion of a conventional fuel supply apparatus.
Figure 23:
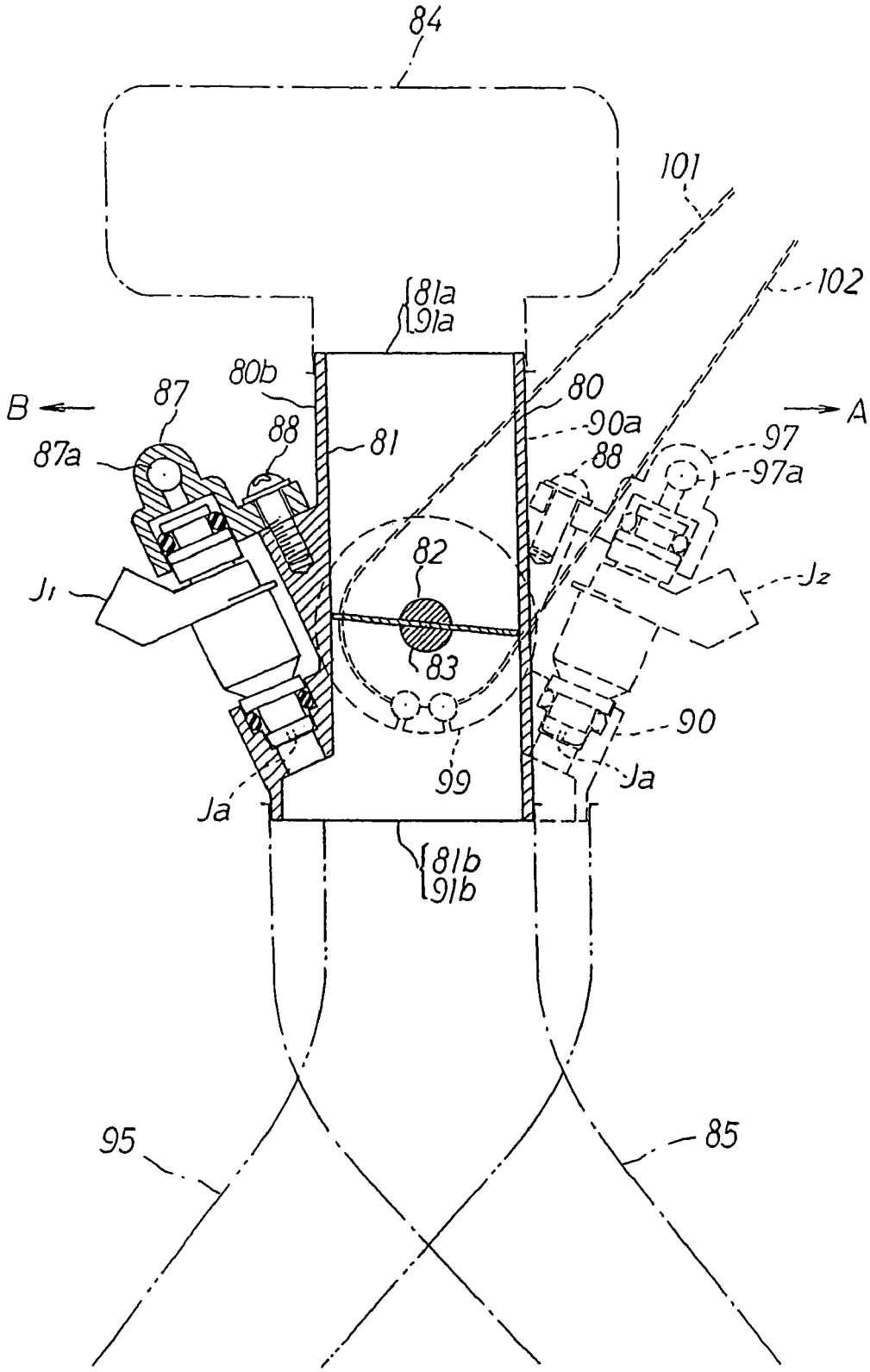
FIG. 23 is a vertical cross sectional view along a line Z—Z in FIG. 22.

This state is disclosed in FIGS. 21 and 18 corresponding to a vertical cross sectional view along a line W—W in FIG. 16.

Further, the second insertion protruding portion 13*b* of the second communicating joint 13 is inserted into the second communicating joint insertion hole 11*m* of the second fuel supply body 11, the screw 14 is inserted into the attaching hole 13*g*, and the screw 14 is screwed toward the female screw hole 11*j* open to the lower side of the second fuel supply body 11.

In accordance with the structure mentioned above, the second communicating joint 13 is firmly fixed to the lower surface of the second fuel supply body 11, and the second insertion protruding portion 13*b* is arranged so as to be fixed within the second communicating joint insertion hole 11*m*.

Figure 20:
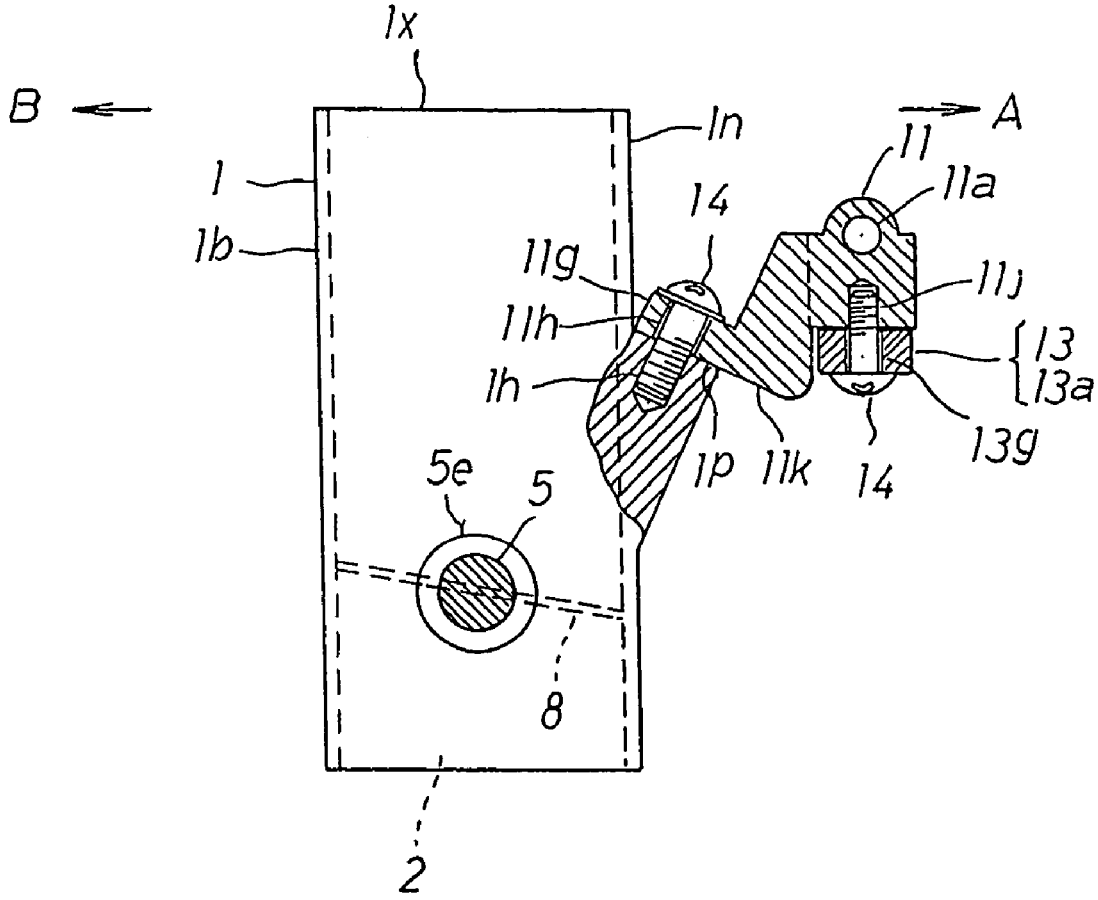
FIG. 20 is a vertical cross sectional view along a line V—V in FIG. 16.

This state is disclosed in FIGS. 21 and 20 corresponding to a vertical cross sectional view along a line W—W in FIG. 16.

Further, the first joint portion 12*c* of the first communicating joint 12 and the second joint portion 13*c* of the second communicating joint 13 are communicated by a fuel communicating pipe 16.

In this case, in the present embodiment, a pressure regulator R is arranged in the opening portion 11*b* of the second fuel supply body 11, and a fuel chamber Ra of the pressure regulator R is connected to the second fuel distribution path 11*a* of the second fuel supply body 11 via a fuel inlet Rb.

Next, a description will be given of an operation thereof.

The pressure of the fuel within the fuel tank (not shown) is increased by the fuel pump, and the fuel having the increased pressure is supplied into the first fuel distribution path 10*a* of the first fuel supply body 10 via a fuel pipe 89 and the fuel inflow path 10*b*.

Further, a part of the fuel existing within the first fuel distribution path 10*a* is supplied toward the upper portion Jb of the first fuel injection valve J1 from the first injection valve inserting hole 10*f*, and is injected and supplied toward a center direction within the first intake path 2 of the first throttle body 1 via the injection hole Jc of the lower portion Ja.

On the other hand, the other portion of the fuel existing within the first fuel distribution path 10*a* is supplied to the first flow path 12*f* of the first communicating joint 12 from the first communicating joint insertion hole 10*m*, and the fuel is supplied into the second fuel distribution path 11*a* of the second fuel supply body 11 via the first joint portion 12*c*, the fuel communicating pipe 16, the second fuel joint 13*c* of the second communicating joint 13, the second flow path 13*f* and the second communicating joint insertion hole 11*m* of the second fuel supply body 11.

Further, a part of the fuel within the second fuel distribution path 11*a* is supplied toward the upper portion Jb of the second fuel injection valve J2 from the second injection valve insertion hole 11*f*, and is injected and supplied in the center direction within the second intake path 4 of the second throttle body 3 via the injection hole Jc of the lower portion Ja.

In this case, in the present embodiment, since the pressure regulator R is arranged in the opening portion 11*b* of the second fuel distribution path 11*a* of the second fuel supply body 11, the other portion of the fuel within the second fuel distribution path 11*a* is introduced into the fuel chamber Ra via the opening portion 11*b* and the fuel inlet Rb, whereby it is possible to regulate the pressure of the fuel flowing within the first and second fuel distribution paths 10*a* and 11*a* to a desired fixed pressure. (Since the pressure regulator R is known, a description of the fuel pressure regulating operation will be omitted.)

In this case, the fuel supply apparatus in accordance with the present invention is characterized in that the fuel communicating pipe 16 for communicating of the first fuel distribution path 10*a* of the first fuel supply body 10 arranged in the one side outer surfaces 1*b* and 3*b* of the first and second throttle bodies 1 and 3 and the second fuel distribution path 11*a* of the second fuel supply body 11 arranged in the other side outer surfaces la and 3*a* of the first and second throttle bodies 1 and 3 is connected via an adjacent space (shown in FIG. 16) formed in a region Y between opposing side surfaces of the left side outer surface 1*y* of the first throttle body 1 and the right side outer surface 3*y* of the second throttle body 3 in the horizontal direction, and in a region X (shown in FIG. 21) between the upper side of the throttle valve shaft 5 and the upper ends 1*x* and 3*x* of the respective throttle bodies 1 and 3 in the vertical direction thereof.

In accordance with the structure mentioned above, the first fuel distribution path 10*a* can communicate with the second fuel distribution path 11*a* at a shortest distance by the fuel communicating pipe 16, and it is possible to make the pipe length of the fuel communicating pipe 16 short.

In accordance with this structure, it is possible to inhibit the fuel communicating pipe 16 from being heated up due to the influence of the temperature of the ambient atmosphere of the engine, and it is possible to prevent the fuel from being evaporated within the fuel communicating pipe 16, thereby preventing the vapor from being generated. In accordance with the structure mentioned above, the fuel flow from the first fuel distribution path 10*a* toward the second fuel distribution path 11*a* is not interrupted by the vapor, it is possible to always maintain a smooth fuel flow, and it is possible to always supply the stable fuel continuously and accurately from the second fuel injection valve J2.

Further, since the fuel communicating pipe 16 can be made short, the support member is not necessarily provided for preventing the fuel communicating pipe 16 from deflecting and wobbling.

Further, since the lower side of the fuel communicating pipe 16 is protected by the bearing boss Se including the throttle valve shaft 5, the upper side thereof is protected by the air cleaner box, and the side portion thereof is protected by the outer surfaces 1*g* and 3*g* of the first and second throttle bodies 1 and 3, no particular novel protecting member is necessary. Accordingly, the structure is preferably applied to the two-wheel vehicle in which the fuel supply apparatus is arranged so as to be directly exposed to the exterior.

Further, since the fuel communicating pipe 16 is arranged within the adjacent space of the first and second throttle bodies 1 and 3, the fuel communicating pipe 16 does not interfere with the other members (for example, a frame, a seat or the like) than the fuel supply apparatus, and it is possible to largely improve a layout property of the fuel communicating pipe 16. Further, since the fuel communicating pipe 16 is arranged in the inner portion of the fuel supply apparatus, it is possible to arrange an outer appearance neat at a time of applying to the two-wheel vehicle.

Further, in accordance with the present invention, since the first fuel supply body 10 is fixed to the first throttle body 1 via the first attaching hole 10*d* of the first attaching collar portion 10*c*, and fixed to the second throttle body 3 via the second attaching hole 10*h* of the second attaching collar portion 10*g*, the first fuel supply body 10 can be firmly fixed to the throttle body. Further, since the second fuel supply body 11 is fixed to the second throttle body 3 via the first attaching hole 11*d* of the first attaching collar portion 11*c*, and fixed to the first throttle body 1 via the second attaching hole 11*h* of the second attaching collar portion 11*g*, the second fuel supply body 11 can be firmly fixed to the throttle body. Accordingly, in this state, even if the external force is applied to the first fuel supply body 10 at a time of inserting the first insertion protruding portion 12*b* of the first communicating joint 12 into the first communicating joint insertion hole 10*m* and screw fixing the first communicating joint 12 to the first fuel supply body 10 via the attaching hole 12*g*, and attaching the fuel communicating pipe 16 to the first joint portion 12*c*, it is possible to prevent the first fuel supply body 10 from being inclined so as to deteriorate an air tightness between the first injection valve insertion hole 10*f* and the upper portion Jb of the first fuel injection valve J1.

Further, even if the external force is applied to the second fuel supply body 11 at a time of inserting the second insertion protruding portion 13*b* of the second communicating joint 13 into the second communicating joint insertion hole 11*m* and screw fixing the second communicating joint 13 to the second fuel supply body 11 via the attaching hole 13*g*, and attaching the fuel communicating pipe 16 to the second joint portion 13*c*, it is possible to prevent the second fuel supply body 11 from being inclined so as to deteriorate an air tightness between the second injection valve insertion hole 11*f* and the upper portion Jb of the second fuel injection valve J2.

Further, since the outer shapes of the first and second communicating joints 12 and 13 are structured by the first and second insertion protruding portions 12*b* and 13*b*, the first and second attaching collar portions 12*a* and 13*a* and the first and second joint portions 12*c* and 13*c*, the communicating joints 12 and 13 can be formed by the parts having small shapes, and the fuel communicating pipe 16 can be formed by the short linear pipe.

In accordance with the structure mentioned above, it is possible to insert the first and second communicating joints 12 and 13 in which the fuel communicating pipe 16 is attached within the adjacent space of the throttle bodies 1 and 3 after previously assembling the first and second fuel supply bodies 10 and 11 with the respective throttle bodies 1 and 3, and it is possible to thereafter insert and fix the second communicating joint 13 to the second communicating joint insertion hole 11*m* of the second fuel supply body 11, and insert and fix the first communicating joint 12 to the first communicating joint insertion hole 10*m* of the first fuel supply body 10.

In accordance with the structure mentioned above, it is possible to easily execute particularly the attaching work of the fuel communicating pipe 16 to each of the joint portions 12*c* and 13*c* in a short time.

Further, since the pressure regulator R is arranged in the opening portion 11*b* of the second fuel supply body 11, the member for holding the pressure regulator R is not required, so that it is possible to reduce the number of the parts. Further, since the second fuel supply body 11 is firmly fixed to the throttle bodies 1 and 3 with the first attaching collar portion 11*c* and the second attaching collar portion 11*g*, it is possible to securely attach the pressure regulator R.

In the case that the pressure regulator R is arranged near the fuel tank, the opening portion 11*b* may be closed by the closing plug.

Further, if the lower end surface 11*e* of the first attaching collar portion 10*c* in the first fuel supply body 10 and the lower end surface 10*k* of the second attaching collar portion 10*g* are formed at the same angle of incline, it is possible to accurately arrange the first fuel supply body 10 in the horizontal state with respect to the throttle bodies 1 and 3, whereby it is possible to accurately arrange the upper portion Jb of the first fuel injection valve J1 within the first injection valve insertion hole 10*f* of the first fuel supply body 10 without generating the fuel leak.

In the second fuel supply body 11, it is possible to accurately arrange the upper portion Jb of the second fuel injection valve J2 within the second injection valve insertion hole 11*f* of the second fuel supply body 11 without generating the fuel leak in the same manner as mentioned above.

Further, in FIG. 21, a first sub throttle valve 20 is arranged in the first intake path 2 in the upstream side of the first throttle valve 8, and a second sub throttle valve 21 is arranged in the second intake path 4 in the upstream side of the second throttle valve 9. These first sub throttle valve 20 and the second sub throttle valve 21 are attached to a second throttle valve shaft 22 formed by one shaft cutting across from the first intake path 2 toward the second intake path 4.

Further, in correspondence to the rotation of the second throttle valve shaft 22 driven by an electric actuator or the like, the first sub throttle valve 20 opens and closes the first intake path 2 in the upstream side of the first throttle valve 8, and the second sub throttle valve 21 opens and closes the second intake path 4 in the upstream side of the second throttle valve 9.

Further, the fuel communicating pipe communicates via an adjacent space formed between the upper side of the throttle valve shaft 5 and the lower side of the second throttle valve shaft 22 in the vertical direction, between the opposing side surfaces of the left side outer surface 1*y* of the first throttle body 1 and the right side outer surface 3*y* of the second throttle body 3 in the horizontal direction.

In accordance with the structure mentioned above, since the upper side of the fuel communicating pipe 16 can be protected by the second throttle valve shaft 22 and a second throttle valve bearing portion 22*a*, it is possible to further improve a protecting function with respect to the fuel communicating pipe 16.

In this case, the first communicating joint 12 and the second communicating joint 13 to which the end portions of the fuel communicating pipe 16 are inserted may be previously formed integrally in the first fuel supply body 10 and the second fuel supply body 11.

As mentioned above, the most characteristic part of the present invention is that the fuel communicating pipe connecting the first fuel supply body and the second fuel supply body by the flow path is connected via the adjacent space formed between the upper side of the throttle valve shaft constituted by one shaft and the upper end of the throttle body in the vertical direction between the opposing side surfaces of both the throttle bodies in the horizontal direction, in the fuel supply apparatus in which the throttle bodies are arranged in adjacent in the horizontal direction, the first fuel injection valve including the first fuel supply body is arranged in the one side of the throttle bodies, and the second fuel injection valve including the second fuel supply body is arranged in the other side of the throttle bodies.

What is claimed is:

1. A fuel supply apparatus comprising:

a first intake path extending through a first throttle body and a second intake path extending through a second throttle body, said first intake path and said second intake path being arranged in adjacent in a horizontal direction and arranged so as to be parallel in longitudinal axial lines of the respective intake paths;

a first throttle valve and a second throttle valve opening and closing said first and second intake paths, said first and second throttle valves being attached to a throttle valve shaft which is coaxially arranged so as to cut across the respective intake paths; and a first fuel injection valve arranged in one side outer surface of the first throttle body in such a manner that a lower injection hole is inclined toward a center of the first intake path, and a second fuel injection valve arranged in the other side outer surface of the second throttle body in such a manner that a lower injection hole is inclined toward a center of the second intake path, wherein the throttle valve shaft (5) to which the first and second throttle valves (8, 9) are attached, is formed by one shaft and is arranged across toward the second intake path (4) from the first intake path (2), and a throttle drum (6) is fixedly arranged in a left end (5*c*) of the throttle valve shaft (5) protruding from a left side outer surface of the second throttle body (3), wherein said first fuel injection valve (J1) is pinched by a first fuel supply body (10) provided with a fuel inflow path (10*b*) and a first fuel distribution path (10*a*), and by the first throttle body (1), and the second fuel injection valve (J2) is pinched by a second fuel supply body (11) provided with a second fuel distribution path (11*a*) and the second throttle body (3), and wherein a fuel communicating pipe (16) for communicating of the first fuel distribution path (10*a*) of said first fuel supply body (10) and the second fuel distribution path (11*a*) of the second fuel supply body (11) communicates via an adjacent space formed between opposing side surfaces of a left side outer surface (1*y*) of the first throttle body (1) and a right side outer surface (3*y*) of the second throttle body (3) in a horizontal direction thereof, and between an upper side of the throttle valve shaft (5) and an upper end (1*x*, 3*x*) of each of the throttle bodies (1, 3) in a vertical direction thereof.

2. A fuel supply apparatus as claimed in claim 1, wherein said first fuel supply body is formed in parallel to the throttle valve shaft (5), a first injection valve insertion hole (10*f*) for inserting an upper portion (Jb) of the first fuel injection valve (J1) and communicating with the first fuel distribution path (10*a*), and a first attaching collar portion (10*c*) provided with a first attaching hole (10*d*) are formed near a right end thereof, a second attaching collar portion (10*g*) provided with a second attaching hole (10*h*) is formed near a left end thereof, and a first communicating joint insertion hole (10*m*) communicating with the first fuel distribution path (10*a*) is formed between the first and second attaching collar portions (10*c*, 10*g*), wherein said second fuel supply body (11) is formed in parallel to the throttle valve shaft (5), a second injection valve insertion hole (11*f*) for inserting an upper portion (Jb) of the second fuel injection valve (J2) and communicating with the second fuel distribution path (11*a*), and a first attaching collar portion (11*c*) provided with a first attaching hole (11*d*) are formed near a left end thereof, a second attaching collar portion (11*g*) provided with a second attaching hole (11*h*) is formed near a right end thereof, and a second communicating joint insertion hole (11*m*) communicating with the second fuel distribution path (11*a*) is formed between the first and second attaching collar portions (11*c*, 11*g*), where in said first fuel supply body (10) is screwed with the first throttle body (1) via the first attaching hole (10*d*) of the first attaching collar portion (10*c*) and is screwed with the second throttle body (3) via the second attaching hole (10*h*) of the second attaching collar portion (10*g*), the second fuel supply body (11) is screwed with the second throttle body (3) via the first attaching hole (11*d*) of the first attaching collar portion (11*c*) and is screwed with the first throttle body (1) via the second attaching hole (11*h*) of the second attaching collar portion (11*g*), a first communicating joint (12) is inserted to the first communicating joint insertion hole (10*m*) so as to be fixedly arranged in the first fuel supply body (10), and a second communicating joint (13) is inserted to the second communicating joint insertion hole (11*m*) so as to be fixedly arranged in the second fuel supply body (11), and wherein said first communicating joint and the second communicating joint (13) communicate by a fuel communicating pipe (16).

3. A fuel supply apparatus as claimed in claim 1, wherein any one of a right end and a left end of the second fuel distribution path (11*a*) of said second fuel supply body is open with an opening portion (11*b*), and a pressure regulator (R) is arranged in said opening portion.

4. A fuel supply apparatus as claimed in claim 2, wherein a lower end surface (10*e*) of the first attaching collar portion (10*c*) and a lower end surface (10*k*) of the second attaching collar portion (10*g*) formed in said first fuel supply body are formed at the same angle of incline in a cross section orthogonal to the first fuel distribution path (10*a*), and wherein a lower end surface (11*e*) of the first attaching collar portion (11*c*) and a lower end surface (11*k*) of the second attaching collar portion (11*g*) formed in the second fuel supply body (11) are formed at the same angle of incline in a cross section orthogonal to the second fuel distribution path (11*a*).

5. A fuel supply apparatus as claimed in claim 1, wherein a first sub throttle valve (20) and a second sub throttle valve (21) are arranged in first and second intake paths (2, 4) in an upstream side of the first and second throttle valves (8, 9) of said first and second throttle bodies, wherein said first sub throttle valve (20) and the second sub throttle valve (21) are attached to a second throttle valve shaft (22) constituted by one shaft cutting across to the second intake path (9) from the first intake path (8), and wherein said fuel communicating pipe communicates via an adjacent space formed between opposing side surfaces of a left side outer surface (1*y*) of the first throttle body (1) and a right side outer surface (3*y*) of the second throttle body (3) in a horizontal direction thereof and between an upper side of the throttle valve shaft (5) and a lower side of the second throttle valve shaft (22) in a vertical direction thereof.

* * * * *